United States Patent [19]

Nitsch

[11] Patent Number: 4,702,395

[45] Date of Patent: Oct. 27, 1987

[54] PAINT CAN HANDLE AND SPOUT ATTACHMENT

[76] Inventor: Reinhold Nitsch, 4423 44B Avenue, Delta, British Columbia, Canada

[21] Appl. No.: 653,342

[22] Filed: Sep. 24, 1984

[51] Int. Cl.[4] ..... B65D 25/28

[52] U.S. Cl. ..... 222/109; 222/567; 222/465.1; 220/94 R; 220/318; 220/327

[58] Field of Search ..... 222/567, 569, 570, 465 R, 222/191, 467, 571, 109; 285/87, 312; 403/290; 220/94 R, 85 SP, 318, 327

[56] References Cited

U.S. PATENT DOCUMENTS

| | | | |
|---|---|---|---|
| 200,976 | 3/1878 | Campbell | 222/567 |
| 1,261,687 | 4/1918 | Brandon | 285/312 |
| 2,040,484 | 5/1936 | Hathaway | 222/465 R |
| 2,183,895 | 12/1939 | Reed | 285/87 |
| 2,520,549 | 8/1950 | Jacobsen | 222/569 |
| 3,679,253 | 7/1972 | Simms | 222/465 R |
| 3,853,249 | 12/1974 | Weir, Jr. et al. | 222/570 |
| 3,899,107 | 8/1975 | Gaal | 222/570 |

FOREIGN PATENT DOCUMENTS

| | | | |
|---|---|---|---|
| 647359 | 8/1962 | Canada | 222/109 |
| 361110 | 11/1931 | United Kingdom | 222/109 |

*Primary Examiner*—Joseph J. Rolla
*Assistant Examiner*—Frederick R. Handren
*Attorney, Agent, or Firm*—Mark C. Jacobs

[57] ABSTRACT

An easily attachable one piece device that is a combination paint can pouring spout and handle portion for mounting on a can of paint. The device includes an optional paint return section. The handle is pivotably locked to a securing position.

8 Claims, 9 Drawing Figures

PAINT CAN HANDLE AND SPOUT ATTACHMENT

BACKGROUND OF THE INVENTION

One of the major problems that a commercial painter or home owner faces when desiring to paint with a roller or sprayer is the transfer of paint from the original paint can to a paint tray for the roller or to the spray bottle for the sprayer. Oftimes in pouring excess gets into the crevice where the can lid closes. In addition paint can spill down the front of the can causing wastage of the paint as well as potentially dirtying the painter's hands and/or clothes. Of course there is always the problem that excess spillage could even cause damage to rugs and surrounding areas if paint is being transferred indoors.

Women, especially, have this problem since they have small hands and many times they are unable to completely grasp a quart can let alone a one gallon can even with two hands.

There is a need therefore for a paint can handle to make the pouring of paint easier as well as a spout to simplify the transfer of paint from the paint can to another vessel.

The ability to temporarily store a paint brush to permit either drippage of excess paint or the temporary storage thereof is also desirable.

It is an object of this invention, therefore, to provide a one piece, easily attachable and easily removable combination pouring spout and handle for paint cans.

It is another object of the invention to provide a pouring spout that includes means for temporary storage of a paint brush.

It is yet another object of the invention to provide a removable pouring spout for a paint can that includes a paint return channel.

Yet another object is to provide a combination pouring spout and paint can handle that is readily attachable and detachable from the can.

Other objects of the invention will in part be obvious and will in part appear hereinafter.

The invention accordingly comprises a product possessing the features, properties and the relation of elements which are exemplified in the following detailed disclosure and the scope of the application of which will be indicated in the claims.

For a fuller understanding of the nature and objects of the invention, reference should be had to the following detailed description taken in conjunction with the accompanying drawings.

The paint can shown in the figures forms no part of the instant invention.

SUMMARY OF THE INVENTION

A combination pouring spout and handle for a paint can comprising an interrupted grooved annular member having a pivotable handle disposed on one side of the interruption and a locking means secured to the annular member on the opposite side of the interruption engagable with said handle to secure the device to a paint can is disclosed. The annular member has an upstanding pouring spout mounted normally therefrom and approximately 180° opposite the handle.

The pouring spout may include one or both of an optional paint brush storage member and an optional paint return channel.

DESCRIPTION OF THE PREFERRED EMBODIMENT

Figure 1:
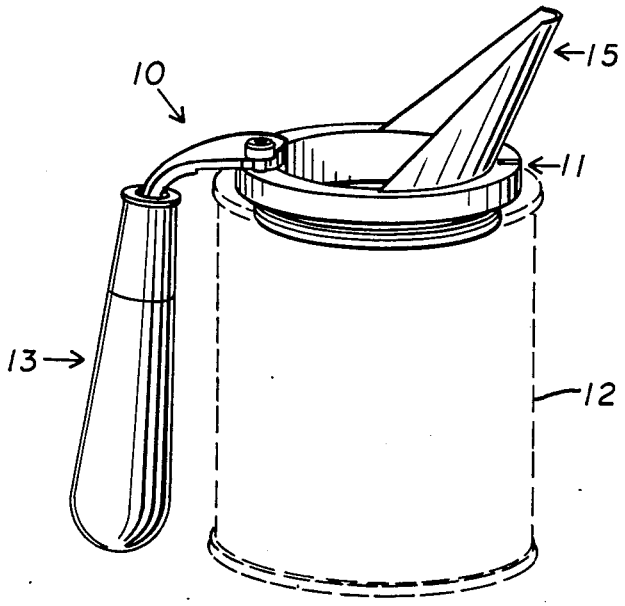
FIG. 1 is a side perspective view of the device of this invention installed on a paint can.
Figure 2:
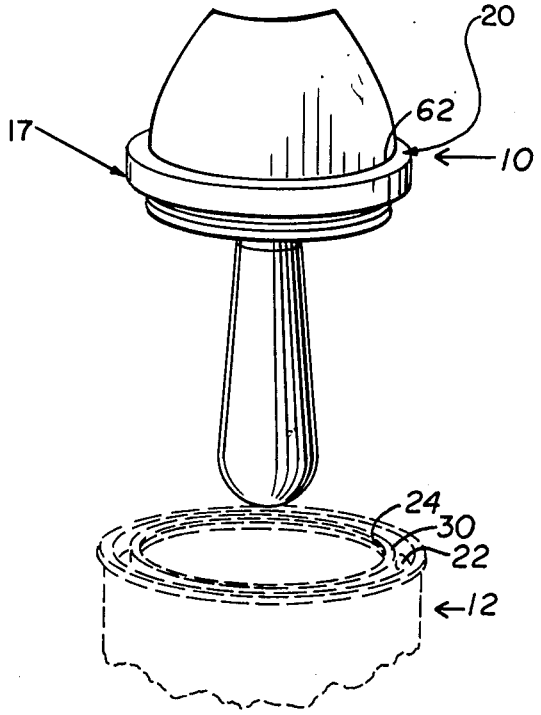
FIG. 2 is a front perspective view of the device of this invention.
Figure 3:
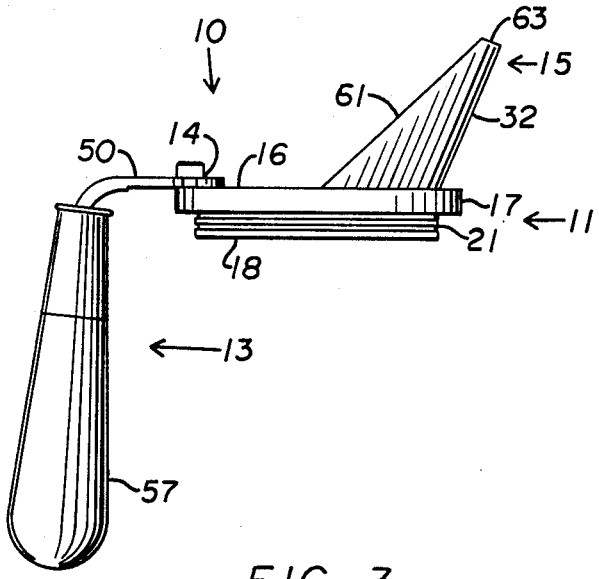
FIG. 3 is a side elevational view showing the device of this invention.
Figure 4:
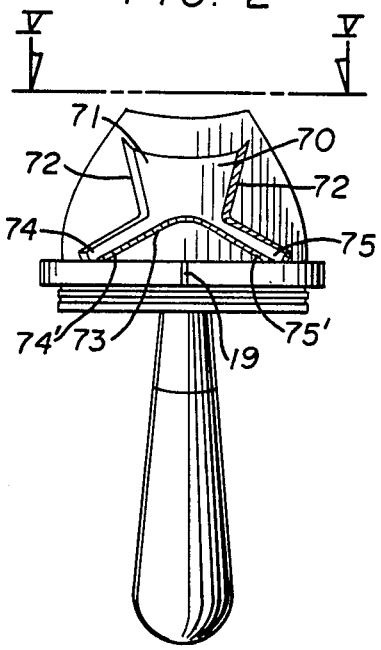
FIG. 4 is a front elevational view of a variant of the invention featuring a paint return channel.

In FIG. 1 invention 10 is shown mounted on a paint can 12. Paint can 12 is a conventional paint can which in this instance is a one quart paint can for the purposes or relative scale. Device 10 can also be manufactured in sizes to fit containers ranging from pint to one gallon and even to five gallon. Device 10 is seen to comprise an interrupted annular member 11 upon which the handle portion 13 and locking means 14 and the pouring spout 15 all of which will be described below are attached. The annular member 11 includes an upper portion 17 and a lower grooved portion 18. (See FIG. 3) At one end, designated the front end, annular member 11 includes a vertical expansion slot 19 disposed outwardly from the outside of the upper portion 17 of annular member 11 toward the outside. This slot 19 extends inwardly approximately ⅔rds of the thickness of the annular member's top section. The purpose of this slot is to allow for movement of the annular member 11 during the locking operation of the handle portion which secures the device 10 to paint can 12. The upper section 17 has a thickness 20 that permits it to completely cover the channel 22 built into the paint can 12 within which the can closure, not seen, rests when the can is sealed shut. The lower section 18 of the annular member 11, while having the same opening in diameter as the top section 17 to permit a continuous pour, has a thinner solid cross section to permit engagement with the interior lip 24 of the paint can 12.

Lower section 18 includes a plurality of annular grooves 21 to enable the lower section 18 to be engaged to the can lip 30 on the securing operation. The interruption 25 at the rear of the bi-level annular member 11 extends through the elevation of both the upper and lower sections 17, 18 respectively of the annular member 11. In the one quart can size. the interruption 25 is seen to be approximately ⅛th inch across when the device is in the unsecured position.

On the top surface 16 of the first section of the annular member 11 there is a bore 40 adapted to receive a threaded post 41. Threaded post 41 includes a head portion 47 having a recess 42 at the top thereof for an allen wrench or alternatively a slot not shown for a slotted screw driver to secure the threaded area of the post 41 into the threaded bore 40 within the annular member 11.

Disposed on the opposite side of interruption 25 also on the top surface 16 of the upper section 20 of the annular member 11 is a second threaded post 44. This threaded post 44 is threadedly secured into a threaded bore in said top section 16. Second threaded post 44 also has a recess 46 in the top thereof for an allen wrench for securing said post 44 into the threaded bore.

Disposed on said second threaded post 44 is handle portion 13. Handle portion 13 is seen to include a generally L-shaped section 50 having a bore 53, receving the second threaded post 44 to permit the L-shaped section to freely rotate about said second threaded post 44

The L-shaped section 50 of the handle portion 13 previously referred to is in fact an inverted L-shaped section having a wider horizontal segment tapering downwardly and rearwardly to a narrower vertical segment. The generally horizontal segment includes a slightly arcuate front edge 52 and bore 53 at the front left corner 54 thereof previously referred to for receiving second threaded post 44. At the right front thereof is a detent 56 which on orientation of the handle portion 13 will frictionally engage first threaded post 40 to fully secure the device 10 upon paint can 12 and place the handle 57 in a locked position.

The downwardly depending segment of the L-shaped section of the handle portion 13 is frictionally engaged in top bore 58 of handle 57. Handles 57 with such top bores are readily available in the marketplace.

It is also within the skill of the art to utilize a different mode of attachment of the downward segment of the L-shaped section to a handle. Such optional attachment means includes the use of one or more screws or bolts or the use of a suitable adhesive in addition to or in place of the threaded engagement of the downwardly depending section into the top bore.

Disposed along the front of the bi-level annular member 11 is pouring spout 15. The pouring spout 15 is seen to be secured approximately around the front third of the annular member 11 and at a slight outward incline to aid in pouring the paint. The pouring spout 15 shown here includes a horizontal top edge 63 to minimize the concentration of the paint thereby eliminating plopping from the receiving vessel outwardly to the surrounding area. Obviously a pointed configuration could be used but should be avoided for the reasons mentioned. Pouring spout 15 is further seen to include a pair of mirror image, arcuately inwardly depending side edges 61. The curvature at the bottom edge 62 is greater than the curvature at the smaller top edge 63. This tends to concentrate the pour of the paint or other fluid toward the middle yet by having the flat top edge 63 the paint or fluid is not overly concentrated.

Figure 5:
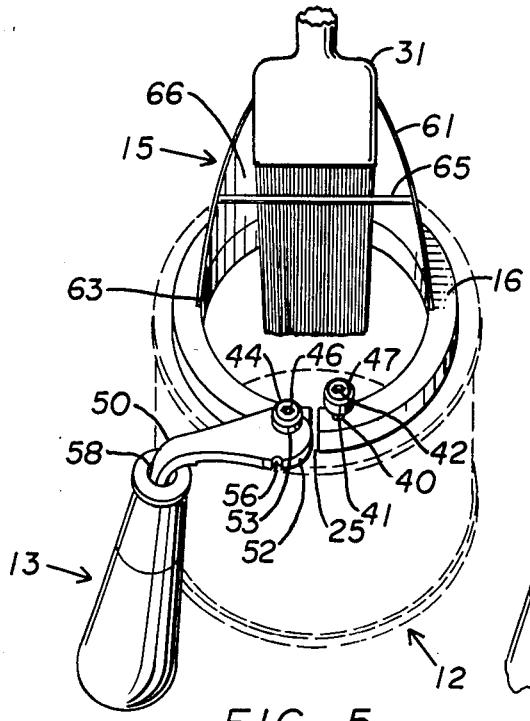
FIG. 5 is a top perspective view of the instant device mounted on the paint can and showing a paint brush temporarily stored in the device.

Shown mounted horizontally at approximately the mid point of the spout 15 is retainer member 65. This rod-like member may be secured in any suitable fashion and by welding if appropriate, adhering or bolting of same to the spout. The rod-like retainer is utilized to create an enclosed space 66 for reception of a paint brush for temporary storage between said rod and the inner surface 31 of the spout. Reference is made to FIG. 5 which shows such storage of a paint brush.

Optionally, mounted on the outside surface 32 of spout 15 is a paint return portion 70. Paint return portion 70 includes a keystone shaped main section 71 which is arcuately configured such that its outer edges 72 in at least a portion thereof can be sealed to the outer surface 32 of the pour spout 15. Keystone shaped main section 71 is seen to be open at the top and curved downwardly and inwardly on its bottom edge 73 to sealingly engage the outer surface of the pour spout 15. A pair of oppositely directed paint return channels 74, 75 are in fluid communication with a portion of the side edges 72 of the keystone main portion 71. The paint return channels 74, 75 may be circular or square configuration when considered separately though the bottom edges 74', 75' of the side walls of the channels are seen to sealingly engage the outer surface 32 of the pour spout.

Figure 8:
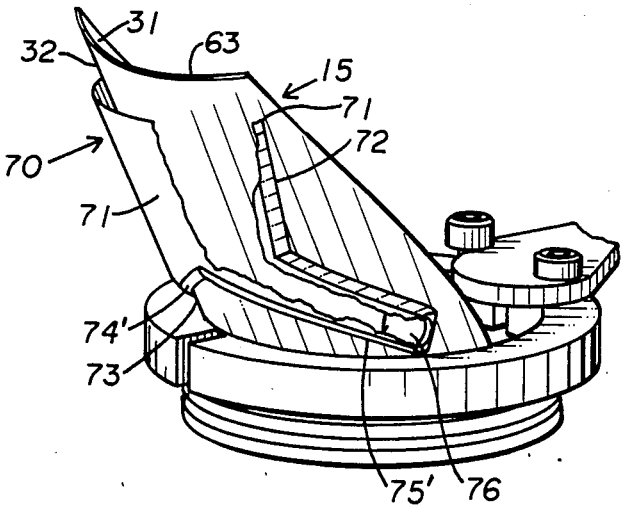
FIG. 8 is a close up perspective view of a portion of this invention showing the optional paint return in cutaway to illustrate the path of the return of the paint to the paint can.

When the optional paint return portion 70 is utilized, a pair of apertures 76 must be placed in the pour spout, which apertures communicate with the paint return channels 74, 75. It is seen therefore that paint returning over the lip 63, i.e. the top edge of the pour spout 15 will drip down into the paint return section 15; first into the keystone shaped main section 71 and then into one or both of the paint return channels 74, 75. The paint will continue down through the channels to the apertures 76 in communication therewith to return the excess paint back into the paint can assuming the paint can is generally vertically disposed. Otherwise if device 10 is in operation, the excess paint will then flow forwardly along the inner surface of the pour spout to the paint can. Reference is made to FIG. 8.

Device 10 can be constructed of any suitable materials. Thus the annular member 11 may be made of a heavy duty plastic such as ABS or polycarbonate, a metal such as steel or bronze. The handle portion 13 comprised of handle 59 and inverted L-shaped segment 50 and both of these may be formed of plastic or metal while the handle can also be made of wood as may be desired.

Figure 6:
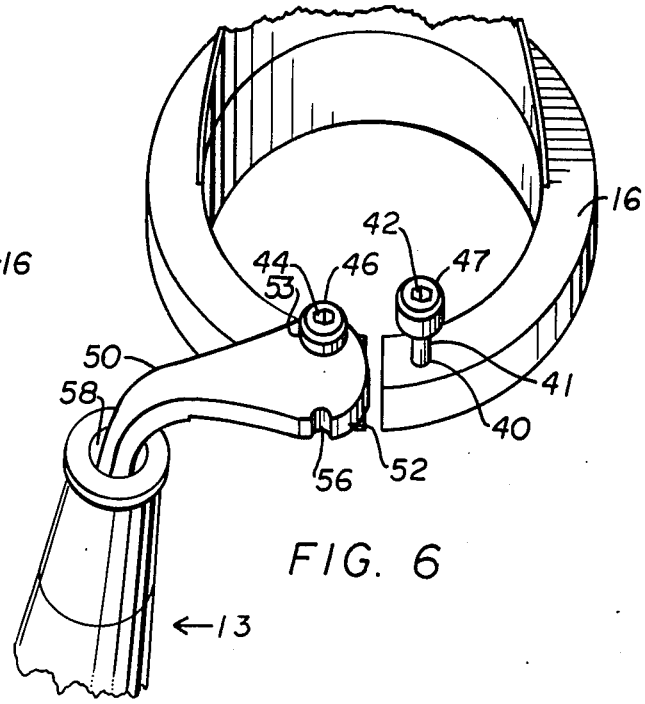
FIG. 6 is a close up view of a portion of the invention showing the handle in the unsecured position.
Figure 7:
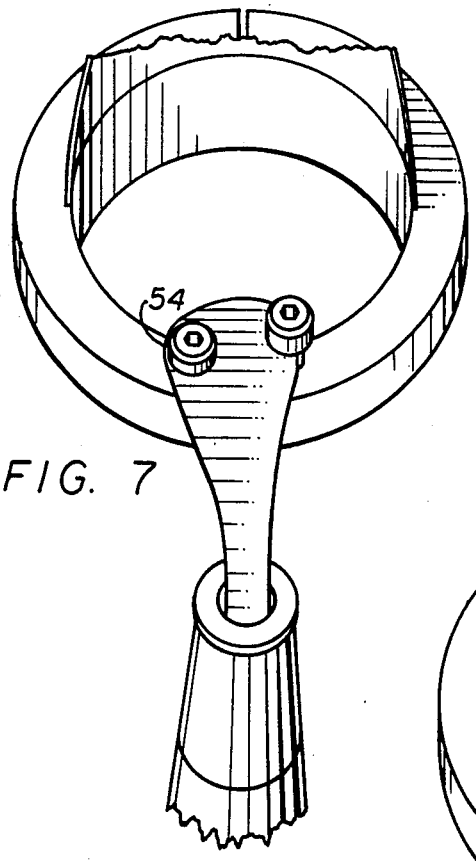
FIG. 7 is a close up view showing the device secured to a paint can with the handle in the locked position.

In order to attach device 10 to paint can 12 the operator places the handle, i.e. a gripping member, in the unlocked position leftwardly as shown in FIG. 6, places the lip 30 of can 12 onto the grooves 18 of the lower annular section until tight and then he/she rotates the handle portion into engagement with first threaded post 40 to secure the handle in a central useable position.

It is seen that I have provided a unique combination pouring spout and handle which may also include one or two optional features. These are optional features are the paint brush retainer member for temporary storage or drippage of excess paint from the brush back into the can which is disposed on one side of the pour spout and a paint return system for excess paint to return back into the paint can through the keystone shaped member and the return channels in fluid communication therewith.

Figure 9:
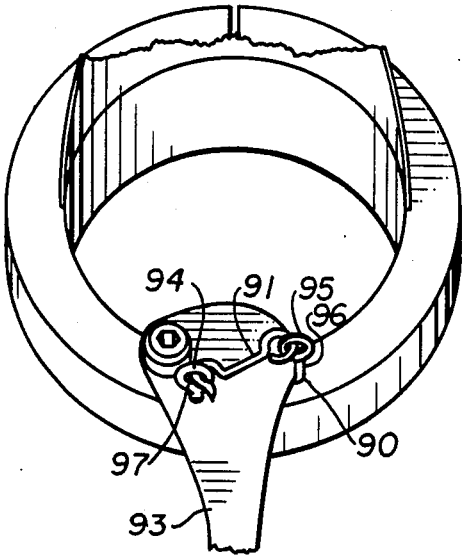
FIG. 9 is a close up perspective view of a variant of a portion of this invention.

While the easiest to manufacture locking means for the handle is the detent system as disclosed herein, it is also to be seen that a hook and eye closure such as that shown in FIG. 9 may be used either in conjunction therewith or as a replacement therefor.

Turning now to FIG. 9 it is seen that first threaded shaft 90 has a hook member 91 mounted thereon via opening 95 and post 96 at one end of said hook which opening 95 is of greater diameter than the threaded post 96 thus permitting free movement of said hook member 91 on said post 96. Mounted upstandingly on said inverted L-shaped section 93 horizontal segment is an eye 94 which is suitably attached by threading engagement or by adhesion to the top of said inverted L-shaped segment 50. When the handle is placed in the central locked position. hook 91 can be engaged in the opening 97 of said eye 94 to secure the handle portion 13 in the centrally disposed useable position. While the handle 59 is shown in these drawings as being mounted on the left side of the interruption 25 with the locking means 14 on the right, it is obvious that the locking means and handle portion can be mounted upon opposite sides of the interruption 25 just as well.

In conclusion, it is seen that there are several aspects to the instant invention. The first and most important of these is the unique pivoting handle portion and locking means. It features a curved, generally L-shaped portion at one end inserted onto the aperture of a handle and being pivotally connected on its opposite end to an annular portion which annular portion is adapted to mount on the upper surface of a can, said opposite end having a camming surface adapted to selectively engage a post mounted on the annular member adjacent thereto, whereby in a first position the L-shaped portion is out of engagement with the post and in the second position, said L-shaped portion cams against and engages said post in a detent whereby said post holds said L-shaped portion when in the engaged position in a fixed relationship thereto. It is further seen that upon entry into the second position, the slot in the interrupted annular member closes slightly.

The second feature is the paint brush holder bar. The third feature is the optional paint return on the pour spout.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. A combination handle and pour spout for a paint can which comprises:

an annular member adapted to be inserted into the lip of a paint can, said annular member provided with an interruption separating closely spaced, confronting ends of said annular member, said annular member having an upper section having a top surface, and a lower grooved section, the lower section having the same opening as the upper section, but of smaller outer diameter, a pour spout extending upwardly from the top surface of the upper section at a location which is diametrically opposite to said interruption, a generally L-shaped handle having:

(1) a first portion overlying and pivotally mounted to the top surface of said annular member on one side of said interruption, (2) a second portion located radially outside of said annular member, and extending downwardly drom said first portion and below the second section of said annular member, said second portion having a gripping member adapted to extend along the side wall of a paint can when the handle and pour spout is installed thereon, and handle locking means mounted to the top surface of said annular member on the opposite side of said interruption.

2. The handle and pour spout of claim 1 wherein the pour spout includes a pair of inwardly curved side edges and a generally flat top edge.

3. The handle and pour spout of claim 1 wherein a paint brush retainer comprising a rod secured at opposite ends to the pour spout and spaced along the length thereof from said pour spout is mounted on said pour spout.

4. The handle and pour spout of claim 1 wherein a paint return means is mounted on one side of said pour spout.

5. The handle and pour spout of claim 4 wherein the paint return means comprises a keystone shaped member secured along its outside edges to the outer surface of the pour spout and having the interior thereof spaced from said pour spout, further including a pair of paint return channels in fluid communication with the lower portion of the interior of said keystone shaped section, said paint return channels in fluid communication each with one of a pair of spaced apertures on opposite sides of said pour spout that communicate to the inside surface of said pour spout.

6. The handle and pour spout of claim 1 wherein said device includes both paint brush retainer means and paint return means, each of which is mounted on the pour spout.

7. The handle and pour spout of claim 1 wherein the handle includes a separate gripping member with a top disposed bore and a curved, generally L-shaped member at one end inserted into the bore of the gripping member the opposite end of the L-shaped member forming the second portion of the handle which is pivotally connected on its opposite end to the annular member, said opposite end of the L-shaped member having a camming surface adapted to selectively engage the locking means which is a post mounted on the annular member adjacent thereto, whereby in a first position the camming surface is out of engagement with the post and in a second engaged position, said camming surface cams against and engages said post whereby said post holds said L-shaped member when in the engaged position in a fixed relationship thereto.

8. The handle and pour spout of claim 1 wherein the first portion of the handle has one of either a hook or eye mounted thereupon for engagement with said locking means which is the other of either a hook or eye mounted adjacent thereto on the top surface of the upper section of said annular member, engagement being possible only upon movement of the handle to a locked position.

* * * * *